US008181461B2

(12) United States Patent
Strimling et al.

(10) Patent No.: US 8,181,461 B2
(45) **Date of Patent: *May 22, 2012**

(54) COOLANT PENETRATING COLD-END PRESSURE VESSEL

(75) Inventors: Jonathan Strimling, Bedford, NH (US); Clement D. Bouchard, Pembroke, NH (US); Thomas Q. Gurski, Goffstown, NH (US); Christopher C. Langenfeld, Nashua, NH (US); Michael Norris, Manchester, NH (US); Ryan Keith LaRocque, Pepperell, MA (US)

(73) Assignee: DEKA Products Limited Partnership, Manchester, NH (US)

( * ) Notice: Subject to any disclaimer, the term of this patent is extended or adjusted under 35 U.S.C. 154(b) by 121 days.

This patent is subject to a terminal disclaimer.

(21) Appl. No.: 11/959,571

(22) Filed: Dec. 19, 2007

(65) Prior Publication Data

US 2008/0092536 A1 Apr. 24, 2008

Related U.S. Application Data

(63) Continuation of application No. 10/361,783, filed on Feb. 10, 2003, now Pat. No. 7,325,399.

(51) Int. Cl.
*F01B 29/10* (2006.01)

(52) U.S. Cl. ..... 60/520; 60/524; 60/526

(58) Field of Classification Search ..... 60/517, 60/520, 524, 526

See application file for complete search history.

(56) References Cited

U.S. PATENT DOCUMENTS

| | | | | |
|---|---|---|---|---|
| 3,940,932 | A * | 3/1976 | Ambrose et al. | 60/417 |
| 6,513,326 | B1 * | 2/2003 | Maceda et al. | 60/517 |
| 7,325,399 | B2 * | 2/2008 | Strimling et al. | 60/520 |

FOREIGN PATENT DOCUMENTS

DE 3500124 * 7/1986

* cited by examiner

*Primary Examiner* — Hoang Nguyen
(74) *Attorney, Agent, or Firm* — Michelle Saquet Temple

(57) ABSTRACT

An improvement is provided to a pressurized close-cycle machine that has a cold-end pressure vessel and is of the type having a piston undergoing reciprocating linear motion within a cylinder containing a working fluid heated by conduction through a heater head by heat from an external thermal source. The improvement includes a heat exchanger for cooling the working fluid, where the heat exchanger is disposed within the cold-end pressure vessel. The heater head may be directly coupled to the cold-end pressure vessel by welding or other methods. A coolant tube is used to convey coolant through the heat exchanger.

16 Claims, 6 Drawing Sheets

COOLANT PENETRATING COLD-END PRESSURE VESSEL

RELATED APPLICATIONS

This application is a continuation of copending U.S. patent application Ser. No. 10/361,783, filed Feb. 10, 2003, published on Aug. 12, 2004 as Publication No. US-20040154297-A1, which is incorporated herein by reference.

TECHNICAL FIELD

The present invention pertains to the pressure containment structure and cooling of a pressurized close-cycle machine.

BACKGROUND OF THE INVENTION

Stirling cycle machines, including engines and refrigerators, have a long technological heritage, described in detail in Walker, Stirling Engines, Oxford University Press (1980), incorporated herein by reference. The principle underlying the Stirling cycle engine is the mechanical realization of the Stirling thermodynamic cycle: isovolumetric heating of a gas within a cylinder, isothermal expansion of the gas (during which work is performed by driving a piston), isovolumetric cooling, and isothermal compression.

In the prior art, the heat transfer structure between the working gas and the cooling fluid also contains the high pressure working gas of the Stirling cycle engine. The two functions of heat transfer and pressure containment produce competing demands on the design. Heat transfer is maximized by as thin a wall as possible made of the highest thermal conductivity material. However, thin walls of weak materials limit the maximum allowed working pressure and therefore the power of the engine. In addition, codes and product standards require designs that can be proof tested to several times the nominal working pressure.

SUMMARY OF THE INVENTION

In accordance with preferred embodiments of the present invention, an improvement is provided to a pressurized close-cycle machine that has a cold-end pressure vessel and is of the type having a piston undergoing reciprocating linear motion within a cylinder containing a working fluid heated by conduction through a heated head by heat from an external thermal source. The improvement includes a heat exchanger for cooling the working fluid, where the heat exchanger is disposed within the cold-end pressure vessel. The heater head may be directly coupled to the cold-end pressure vessel by welding or other methods. In one embodiment, the heater head includes a step or flange transfers a mechanical load from the heater head to the cold-end pressure vessel.

In accordance with a further embodiment of the invention, the pressurized close-cycle machine includes a coolant tube for conveying coolant to the heat exchanger from outside the cold-end pressure vessel and through the heat exchanger and for conveying coolant from the heat exchanger to outside the cold-end pressure vessel. The coolant tube may be a single continuous section of tubing. In one embodiment, a section of the coolant tube is contained within the heat exchanger. The section of the coolant tube contained within the heat exchanger may be a continuous section of tubing. An outside diameter of a section of the coolant tube that passes through the cold-end pressure vessel may be sealed to the cold-end pressure vessel. In one embodiment, a section of the coolant tube is wrapped around an interior of the heat exchanger.

In another embodiment, a section of the coolant tube is disposed within a working volume of the heat exchanger. The section of the coolant tube disposed within the working volume of the heat exchanger may include a plurality of extended heat transfer surfaces. At least one spacing element may be included to direct the flow of the working gas to a specified proximity of the section of coolant tube in the working volume of the heat exchanger. The heat exchanger may further include an annular heat sink surrounding the coolant tube wherein a flow of the working gas in the working volume of the heat exchanger is directed along at least one surface of the annular heat sink. The heat exchanger may further include a plurality of heat transfer surfaces on at least one surface of the heat exchanger.

In yet another embodiment, the cold-end pressure vessel contains a charge fluid and a section of coolant tube is disposed within the cold-end pressure vessel to cool the charge fluid. The pressurized close-cycle machine may also include a fan in the cold-end pressure vessel to circulate and cool the charge fluid. The section of coolant tube disposed within the cold-end pressure vessel may include extended heat transfer surfaces on the exterior of the coolant tube. In a further embodiment, the heat exchanger has a body formed by casting a metal over the coolant tube. The heat exchanger body may include a working fluid contact surface comprising a plurality of extended heat transfer surfaces. A flow constricting countersurface may be used to confine any flow of the working fluid to a specified proximity of the heat exchanger body.

In accordance with another aspect of the invention, a heat exchanger is provided for cooling a working fluid in an external combustion engine. The heat exchanger includes a length of metal tubing for conveying a coolant through the heat exchanger and a heat exchanger body that is formed by casting a material over the metal tubing. In one embodiment, the heat exchanger body includes a working fluid contact surface that comprises a plurality of extended heat transfer surfaces. The heat exchanger may further include a flow-constricting countersurface for confining any flow of the working fluid to a specified proximity to the heat exchanger body.

In accordance with another aspect of the invention, a method is provided for fabricating a heat exchanger for transferring thermal energy from a working fluid to a coolant. The method includes forming a spiral shaped section of tubing and casting a material over the annular shaped section of tubing to form a heat exchanger body.

BRIEF DESCRIPTION OF THE DRAWINGS

The invention will be more readily understood by reference to the following description, taken with the accompanying drawings, in which.

DETAILED DESCRIPTION OF PREFERRED EMBODIMENTS

In accordance with embodiments of the present invention, the heat transfer and pressure vessel functions of the cooler of a pressurized close-cycle machine are separated, thereby advantageously maximizing both the cooling of the working gas and the allowed working pressure of the working gas. Increasing the maximum allowed working pressure and cooling both result in increased engine power. Embodiments of the invention achieve good heat transfer and meet code requirements for pressure containment by using small (relative to the heater head diameter) metal tubing to transfer heat and separate the cooling fluid from the high pressure working gas.

Figure 1:
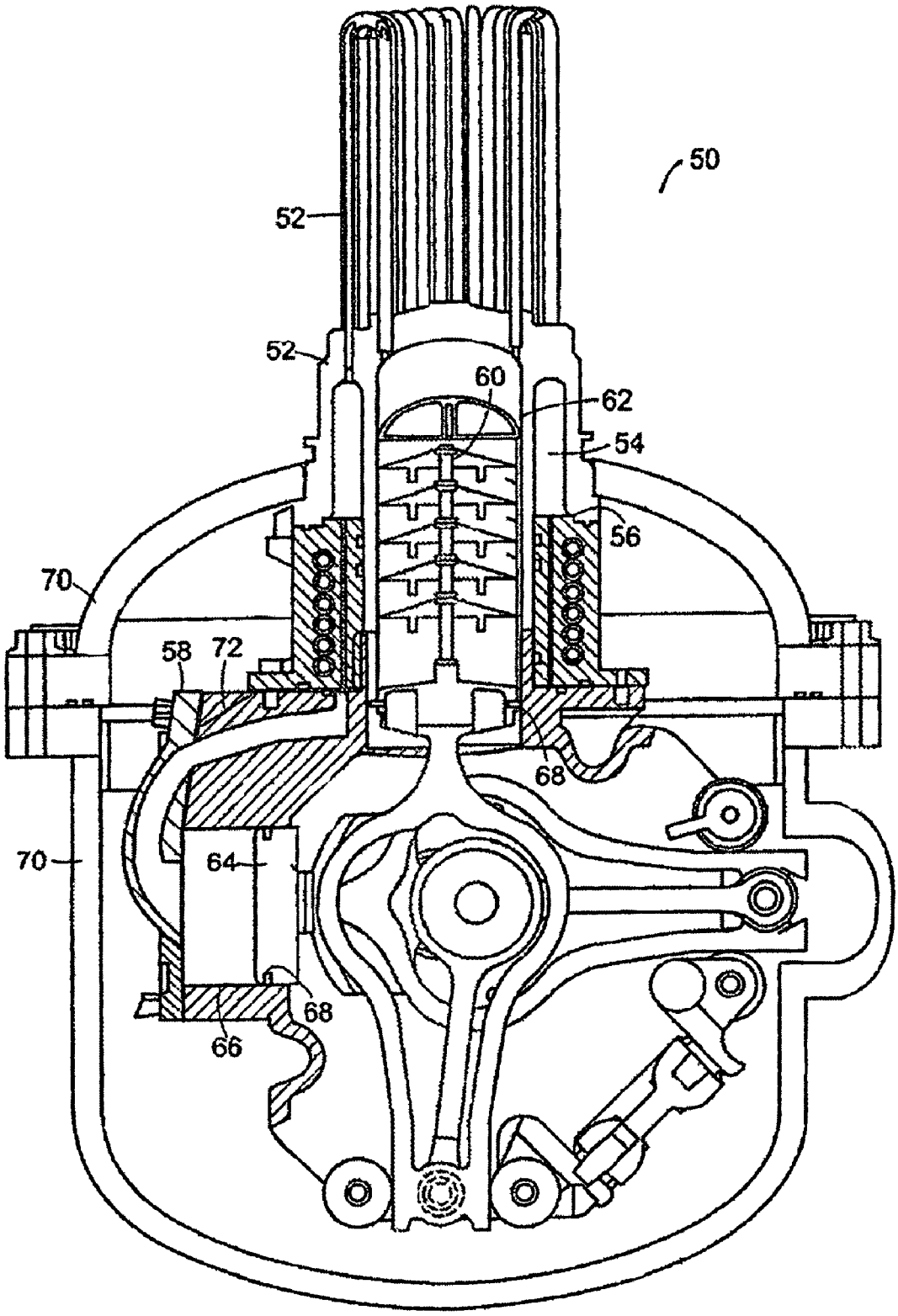
FIG. 1 is a cross-sectional view of a Stirling cycle engine including working spaces in accordance with an embodiment of the present invention.
Figure 2:
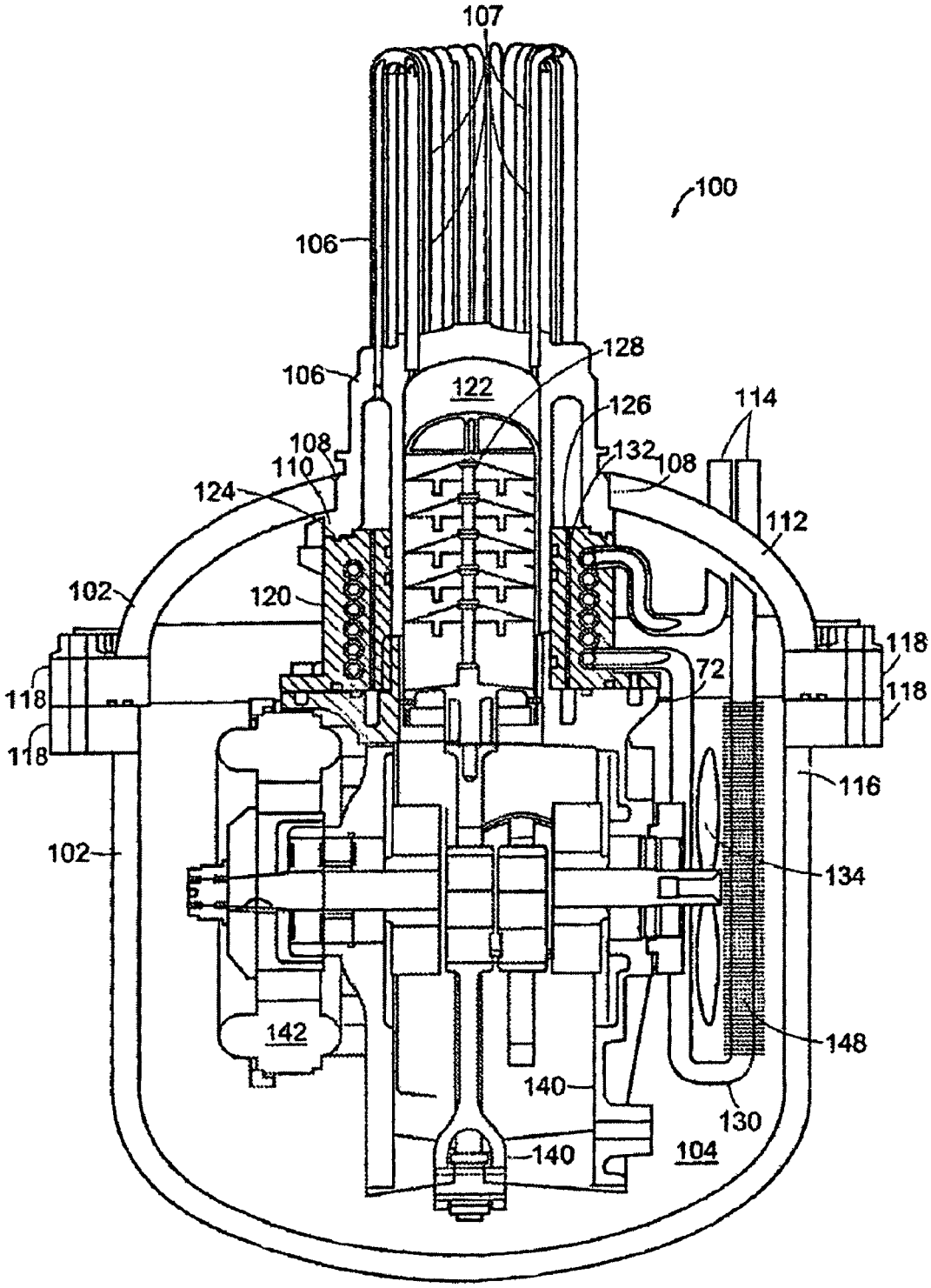
FIG. 2 is a cross-section taken perpendicular to the Stirling cycle engine in FIG. 1 in accordance with an embodiment of the present invention.

Referring now to FIG. 1, a hermetically sealed Stirling cycle engine, in accordance with preferred embodiments of the present invention, is shown in cross section and designated generally by numeral 50. While the invention will be described generally with reference to a Stirling engine as shown in FIG. 1 and FIG. 2, it is to be understood that many engines, coolers, and other machines may similarly benefit from various embodiments and improvements which are subjects of the present invention. A Stirling cycle engine, such as shown in FIG. 1, operates under pressurized conditions. Stirling engine 50 contains a high-pressure working fluid, preferably helium, nitrogen or a mixture of gases at 20 to 140 atmospheres pressure. Typically, a crankcase 70 encloses and shields the moving portions of the engine as well as maintains the pressurized conditions under which the Stirling engine operates (and as such acts as a cold-end pressure vessel). A free-piston Stirling engine also uses a cold-end pressure vessel to maintain the pressurized conditions of the engine. A heater head 52 serves as a hot-end pressure vessel.

Stirling engine 50 contains two separate volumes of gases, a working gas volume and a charge gas volume, separated by piston seal rings 68. In the working gas volume, working gas is contained by heater head 52, a regenerator 54, a cooler 56, a compression head 58, an expansion piston 60, an expansion cylinder 62, a compression piston 64 and a compression cylinder 66 and is contained outboard of the piston seal rings 68. The charge gas is a separate volume of gas enclosed by the cold-end pressure vessel 70, the expansion piston 60, the compression piston 64 and is contained inboard of the piston seal rings 68.

The working gas is alternately compressed and expanded by the compression piston 64 and the expansion piston 60. The pressure of the working gas oscillates significantly over the stroke of the pistons. During operation, there may be leakage across the piston seal rings 68 because the piston seal rings 68 are not hermetic. This leakage results in some exchange of gas between the working gas volume and the charge gas volume. However, because the charge gas in the cold-end pressure vessel 70 is charged to the mean pressure of the working gas, the net mass exchange between the two volumes is zero.

FIG. 2 shows a cross-section of the Stirling cycle engine in FIG. 1 taken perpendicular to the view in FIG. 1 in accordance with an embodiment of the invention. Stirling cycle engine 100 is hermetically sealed. A crankcase 102 serves as the cold-end pressure vessel and contains a charge gas in an interior volume 104 at the mean operating pressure of the engine. Crankcase 102 can be made arbitrarily strong without sacrificing thermal performance by using sufficiently thick steel or other structural material. A heater head 106 serves as the hot-end pressure vessel and is preferably fabricated from a high temperature super-alloy such as Inconel 625, GMR-235, etc. Heater head 106 is used to transfer thermal energy by conduction from an external thermal source (not shown) to the working fluid. Thermal energy may be provided from various heat sources such as solar radiation or combustion gases. For example, a burner may be used to produce hot combustion gases 107 that are used to heat the working fluid. An expansion cylinder (or work space) 122 is disposed inside the heater head 106 and defines part of a working gas volume as discussed above with respect to FIG. 1. An expansion piston 128 is used to displace the working fluid contained in the expansion cylinder 122.

In accordance with an embodiment of the invention, crankcase 102 is welded directly to heater head 106 at joints 108 to create a pressure vessel that can be designed to hold any pressure without being limited, as are other designs, by the requirements of heat transfer in the cooler. In an alternative embodiment, the crankcase 102 and heater head 106 are either brazed or bolted together. The heater head 106 has a flange or step 110 that axially constrains the heater head and transfers the axial pressure force from the heater head 106 to the crankcase 102, thereby relieving the pressure force from the welded or brazed joints 108. Joints 108 serve to seal the crankcase 102 (or cold-end pressure vessel) and bear the bending and planar stresses. In an alternative embodiment, the joints 108 are mechanical joints with an elastomer seal. In yet another embodiment, step 110 is replaced with an internal weld in addition to the exterior weld at joints 108.

Crankcase 102 is assembled in two pieces, an upper crankcase 112 and a lower crankcase 116. The heater head 106 is first joined to the upper crankcase 112. Second, a cooler 120 is installed with a coolant tubing 114 passing through holes in the upper crankcase 112. Third, the expansion piston 128 and the compression piston 64 (shown in FIG. 1) and drive components 140, 142 are installed. The lower crankcase 116 is then joined to the upper crankcase 112 at joints 118. Preferably, the upper crankcase 112 and the lower crankcase 116 are joined by welding. Alternatively, a bolted flange may be employed as shown in FIG. 2.

In order to allow direct coupling of the heater head 106 to the upper crankcase 112, the cooling function of the thermal cycle is performed by a cooler 120 that is disposed within the crankcase 102, thereby advantageously reducing the pressure containment requirements placed upon the cooler. By placing the cooler 120 within crankcase 102, the pressure across the cooler is limited to the pressure difference between the working gas in the working gas volume, including expansion cylinder 122, and the charge gas in the interior volume 104 of the crankcase. The difference in pressure is created by the compression and expansion of the working gas, and is typically limited to a percentage of the operating pressure. In one embodiment, the pressure difference is limited to less than 30% of the operating pressure.

Coolant tubing 114 advantageously has a small diameter relative to the diameter of the cooler 120. The small diameter of the coolant passages, such as provided by coolant tubing 114, is key to achieving high heat transfer and supporting large pressure differences. The required wall thickness to withstand or support a given pressure is proportional to the tube or vessel diameter. The low stress on the tube walls allows various materials to be used for coolant tubing 114 including, but not limited to, thin-walled stainless steel tubing or thicker-walled copper tubing.

An additional advantage of locating the cooler 120 entirely within the crankcase 102 (or cold-end pressure vessel) volume is that any leaks of the working gas through the cooler 120 will only result in a reduction of engine performance. In contrast, if the cooler were to interface with the external ambient environment, a leak of the working gas through the cooler would render the engine useless due to loss of the working gas unless the mean pressure of working gas is maintained by an external source. The reduced requirement for a leak-tight cooler allows for the use of less expensive fabrication techniques including, but not limited to, powder metal and die casting.

Cooler 120 is used to transfer thermal energy by conduction from the working gas and thereby cool the working gas. A coolant, either water or another fluid, is carried through the crankcase 102 and the cooler 120 by coolant tubing 114. The feedthrough of the coolant tubing 114 through upper crankcase 112 may be sealed by a soldered or brazed joint for copper tubes, welding, in the case of stainless steel and steel tubing, or as otherwise known in the art.

The charge gas in the interior volume 104 may also require cooling due to heating resulting from heat dissipated in the motor/generator windings, mechanical friction in the drive, the non-reversible compression/expansion of the charge gas and the blow-by of hot gases from the working gas volume. Cooling the charge gas in the crankcase 102 increases the power and efficiency of the engine as well as the longevity of bearings used in the engine.

In one embodiment, an additional length of coolant tubing 130 is disposed inside the crankcase 102 to absorb heat from the charge gas in the interior volume 104. The additional length of coolant tubing 130 may include a set of extended heat transfer surfaces 148, such as fins, to provide additional heat transfer. As shown in FIG. 2, the additional length of coolant tubing 130 may be attached to the coolant tubing 114 between the crankcase 102 and the cooler 120. In an alternative embodiment, the length of coolant tubing 130 may be a separate tube with its own feedthrough of the crankcase 102 that is connected to the cooling loop by hoses outside of the crankcase 102.

In an another embodiment, the extended coolant tubing 130 may be replaced with extended surfaces on the exterior surface of the cooler 120 or the drive housing 72. Alternatively, a fan 134 may be attached to the engine crankshaft to circulate the charge gas in interior volume 104. The fan 134 may be used separately or in conjunction with the additional coolant tubing 130 or the extended surfaces on the cooler 120 or drive housing 72 to directly cool the charge gas in the interior volume 104.

Preferably, coolant tubing 114 is a continuous tube throughout the interior volume 104 of the crankcase and the cooler 120. Alternatively, two pieces of tubing could be used between the crankcase and the feedthrough ports of the cooler. One tube carries coolant from outside the crankcase 102 to the cooler 120. A second tube returns the coolant from the cooler 120 to the exterior of the crankcase 102. In another embodiment, multiple pieces of tubing may be used between the crankcase 102 and the cooler in order to add tubing with extended heat transfer surfaces inside the crankcase volume 104 or to facilitate fabrication. The tubing joints and joints between the tubing and the cooler may be brazed, soldered, welded or mechanical joints.

Various methods may be used to join coolant tubing 114 to cooler 120. Any known method for joining the coolant tubing 114 to the cooler 120 is within the scope of the invention. In one embodiment, the coolant tubing 114 may be attached to the wall of the cooler 120 by brazing, soldering or gluing. Cooler 120 is in the form of a cylinder placed around the expansion cylinder 122 and the annular flow path of the working gas outside of the expansion cylinder 122. Accordingly, the coolant tubing 114 may be wrapped around the interior of the cooler cylinder wall and attached as mentioned above.

Figure 3A:
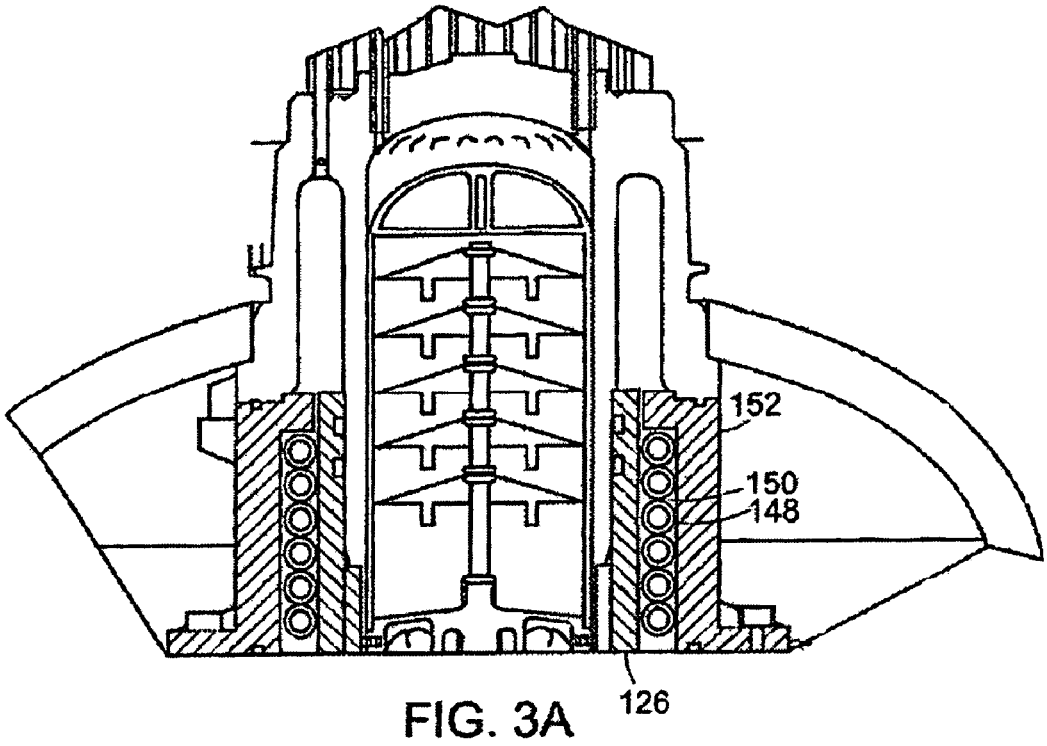
FIG. 3*a* is a side views in cross section of a Stirling cycle engine including coolant tubing in accordance with an embodiment of the invention.
Figure 3B:
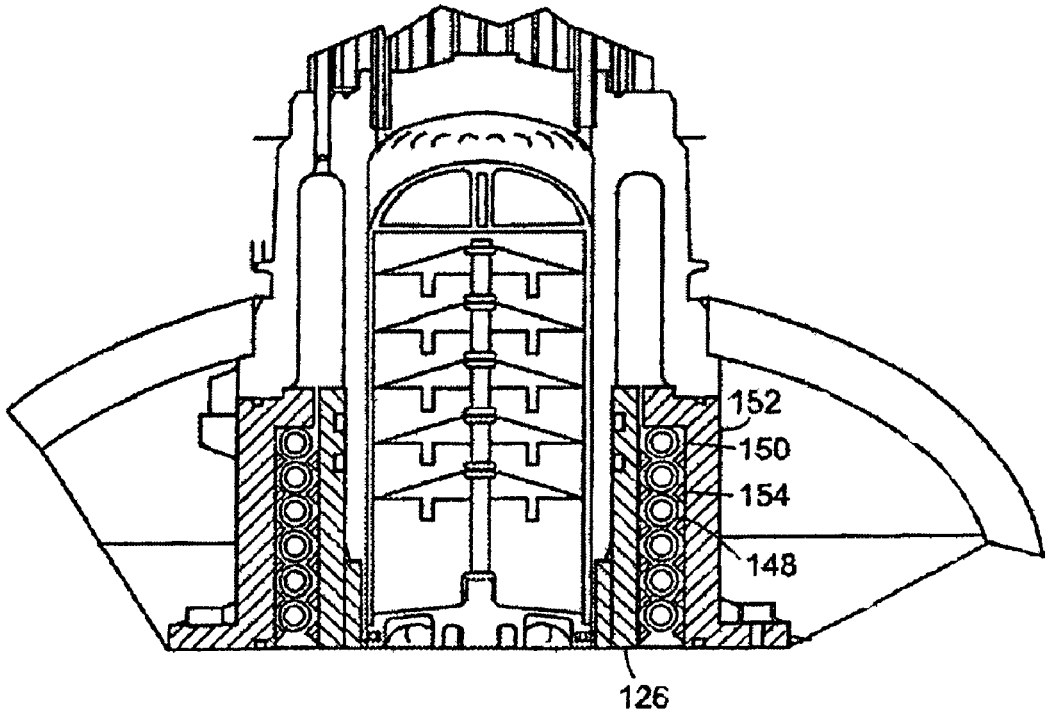
FIG. 3*b* is a side view in cross section of a Stirling cycle engine including coolant tubing in accordance with an alternative embodiment of the invention.

Alternative cooler configurations are presented in FIGS. 3*a*-3*d* that reduce the complexity of the cooler body fabrication. FIG. 3*a* shows a side view of a Stirling cycle engine including coolant tubing in accordance with an embodiment of the invention. In FIG. 3*a*, cooler 152 includes a cooler working space 150. Coolant tubing 148 is placed within the cooler working space 150, so that the working gas can flow over an outside surface of coolant tubing 148. The working gas is confined to flow past the coolant tubing 148 by the cooler body 152 and a cooler liner 126. The coolant tube passes into and out-of the working space 150 through ports in either the cooler 152 or the drive housing 72 (shown in FIG. 2). The cooler casting process is simplified by having a seal around coolant lines 148. In addition, placing the coolant line 148 in the working space improves the heat transfer between the working fluid and the coolant fluid. The coolant tubing 148 may be smooth or may have extended heat transfer surfaces or fins on the outside of the tubing to increase heat transfer between the working gas and the coolant tubing 148. In another embodiment, as shown in FIG. 3*b*, spacing elements 154 may be added to the cooler working space 150 to force the working gas to flow closer to the coolant tubes 148. The spacing elements are separate from the cooler liner 126 and the cooler body 152 to allow insertion of the coolant tube and spacing elements into the working space.

Figure 3C:
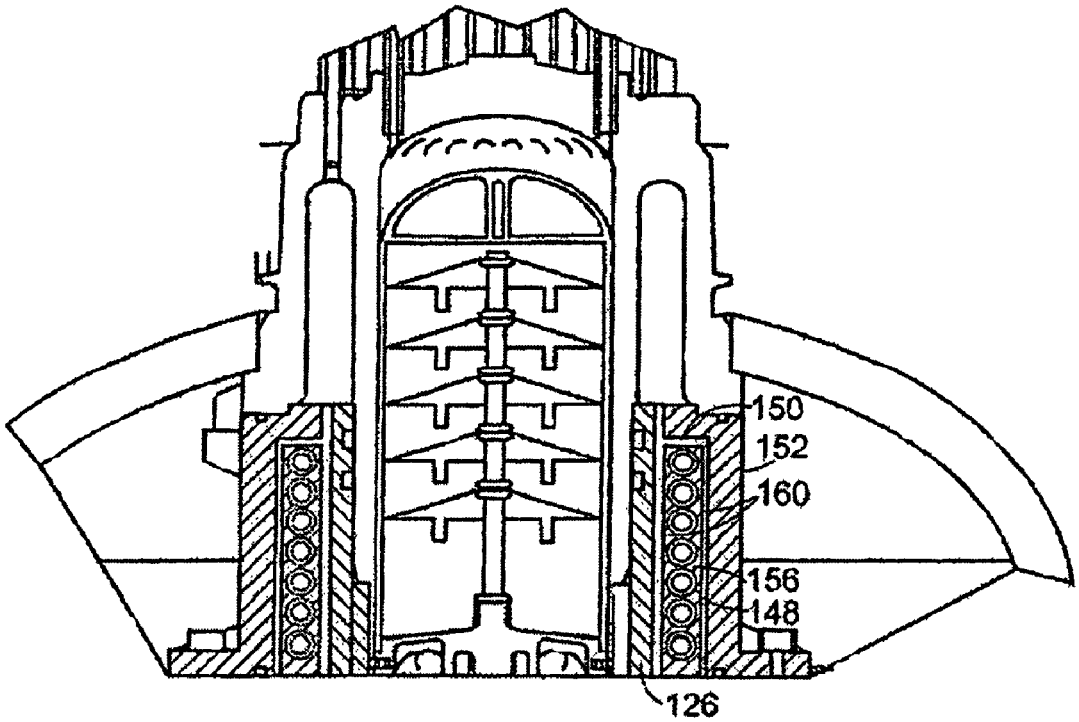
FIG. 3*c* is a side view in cross section of a Stirling cycle engine including coolant tubing in accordance with an alternative embodiment of the invention.
Figure 3D:
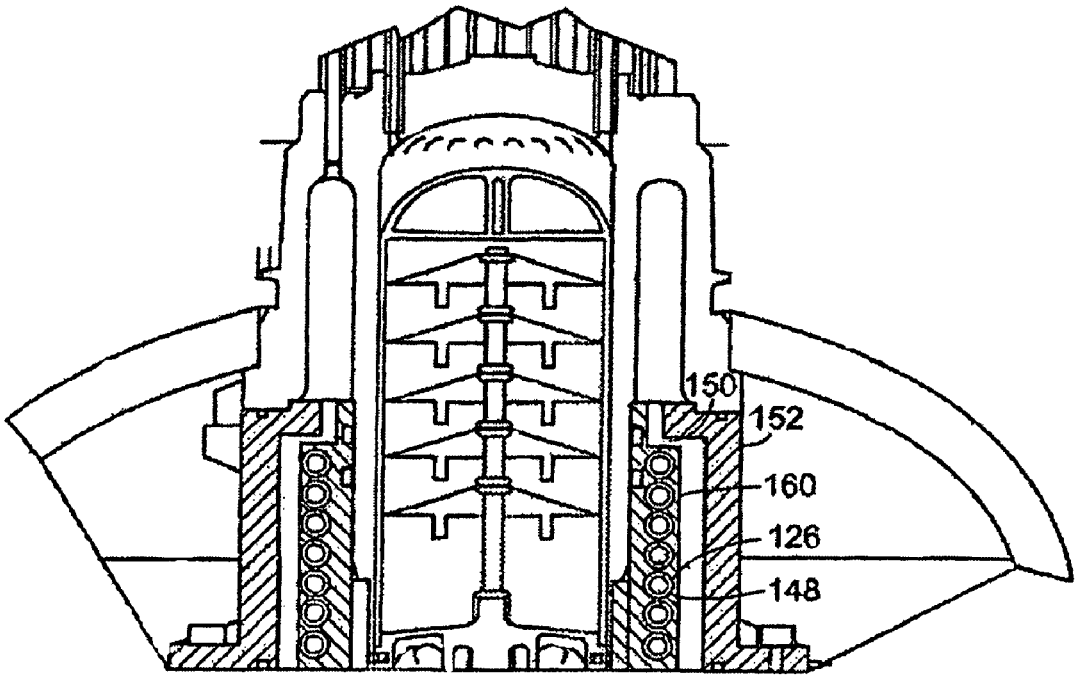
FIG. 3*d* is a side view in cross section of a Stirling cycle engine including coolant tubing in accordance with an alternative embodiment of the invention.

In another embodiment, as shown in FIG. 3*c*, the coolant tubing 148 is overcast to form an annular heat sink 156 where the working gas can flow on both sides of the cooler body 152. The annular heat sink 156 may also include extended heat transfer surfaces on its inner and outer surfaces 160. The body of the cooler 152 constrains the working gas to flow past the extended heat exchange surfaces on heat sink 156. The heat sink 156 is typically a simpler part to fabricate than the cooler 120 in FIG. 2. The annular heat sink 156 provides roughly double the heat transfer area of cooler 120 shown in FIG. 2. In another embodiment, as shown in FIG. 3*d*, the cooler liner 126 can be cast over the coolant lines 148. The cooler body 152 constrains the working gas to flow past the cooler liner 162. Cooler liner 126 may also include extended heat exchange surfaces on a surface 160 to increase heat transfer.

Returning to FIG. 2, a preferred method for joining coolant tubing 114 to cooler 120 is to overcast the cooler around the coolant tubing. This method is described, with reference to FIGS. 4*a* and 4*b*, and may be applied to a pressurized close-cycle machine as well as in other applications where it is advantageous to locate a cooler inside the crankcase.

Figure 4A:
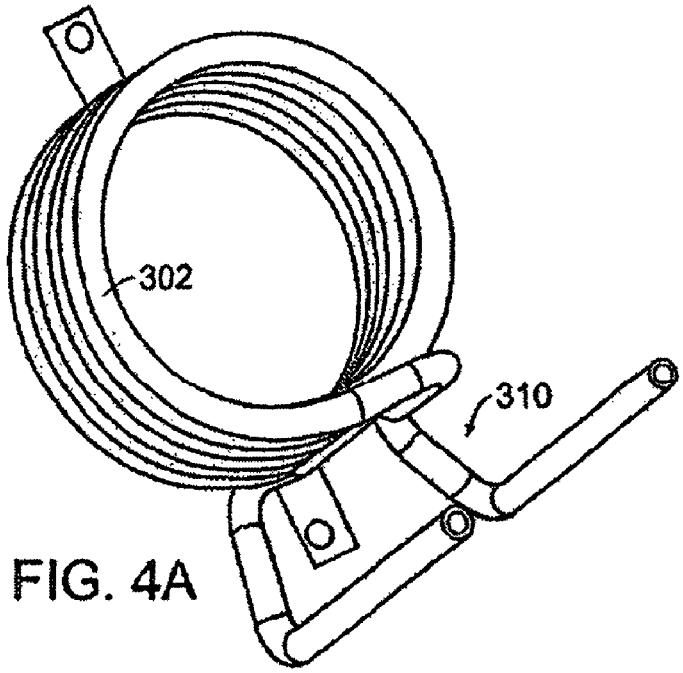
FIG. 4*a* is a perspective view of a cooling coil for heat exchange in accordance with an embodiment of the invention.

Referring to FIG. 4*a*, a heat exchanger, for example, a cooler 120 (shown in FIG. 2) may be fabricated by forming a high-temperature metal tubing 302 into a desired shape. In a preferred embodiment, the metal tubing 302 is formed into a coil using copper. A lower temperature (relative to the melting temperature of the tubing) casting process is then used to overcast the tubing 302 with a high thermal conductivity material to form a gas interface 304 (and 132 in FIG. 2), seals 306 (and 124 in FIG. 2) to the rest of the engine and a structure to mechanically connect the drive housing 72 (shown in FIG. 2) to the heater head 106 (shown in FIG. 2). In a preferred embodiment, the high thermal conductivity material used to overcast the tubing is aluminum. Overcasting the tubing 302 with a high thermal conductivity metal assures a good thermal connection between the tubing and the heat transfer surfaces in contact with the working gas. A seal is created around the tubing 302 where the tubing exits the open mold at 310. This method of fabricating a heat exchanger advantageously provides cooling passages in cast metal parts inexpensively.

Figure 4B:
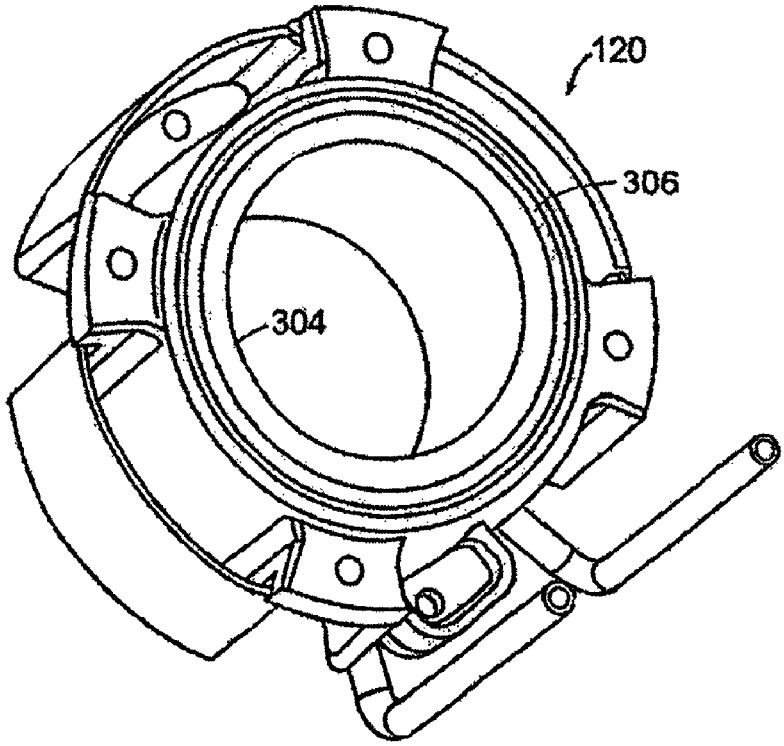
FIG. 4*b* is a perspective view of a cooling assembly cast over the cooling coil of FIG. 4*a* in accordance with an embodiment of the invention.

FIG. 4*b* is a perspective view of a cooling assembly cast over the cooling coil of FIG. 4*a*. The casting process can include any of the following: die casting, investment casting, or sand casting. The tubing material is chosen from materials that will not melt or collapse during the casting process. Tubing materials include, but are not limited to, copper, stainless steel, nickel, and super-alloys such as Inconel. The casting material is chosen among those that melt at a relatively low temperature compared to the tubing. Typical casting materials include aluminum and its various alloys, and zinc and its various alloys.

The heat exchanger may also include extended heat transfer surfaces to increase the interfacial area 304 (and 132 shown in FIG. 2) between the hot working gas and the heat exchanger so as to improve heat transfer between the working gas and the coolant. Extended heat transfer surfaces may be created on the working gas side of the heat exchanger 120 by machining extended surfaces on the inside surface (or gas interface) 304. Referring to FIG. 2, a cooler liner 126 (shown in FIG. 2) may be pressed into the heat exchanger to form a gas barrier on the inner diameter of the heat exchanger. The cooler liner 126 directs the flow of the working gas past the inner surface of the cooler.

Figure 5B:
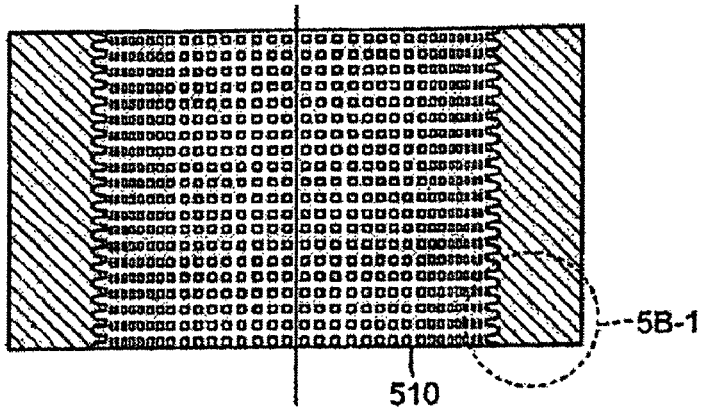
FIG. 5*b* is a detailed cross sectional top view of the interior section of the overcast cooling heat exchanger of FIG. 4*b* showing vertical and horizontal grooves creating heat exchange pins in accordance with another embodiment of the invention.
Figures 1, 5B:
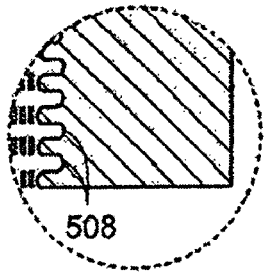
Figure 5A:
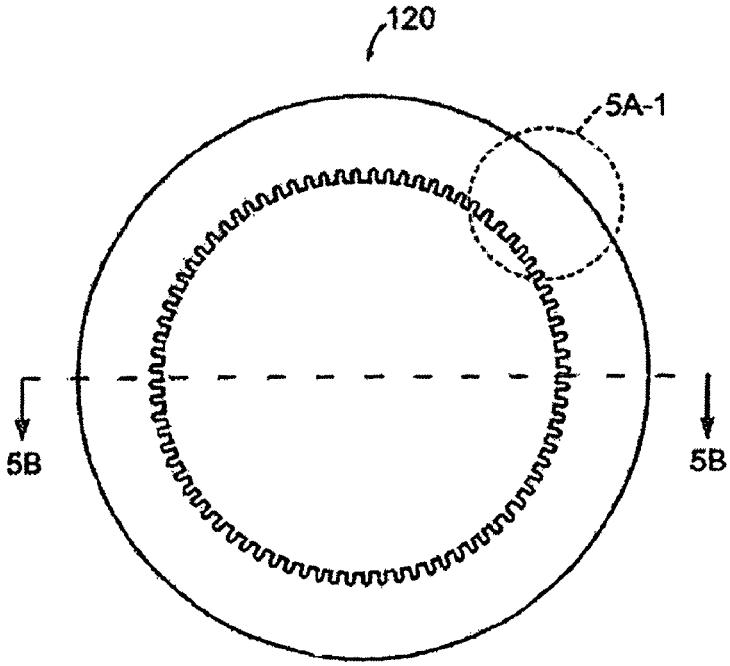
FIG. 5*a* is a detailed cross sectional top view of the interior section of the overcast cooling heat exchanger of FIG. 4*b* showing vertical grooves in accordance with an embodiment of the invention.
Figures 1, 5A:
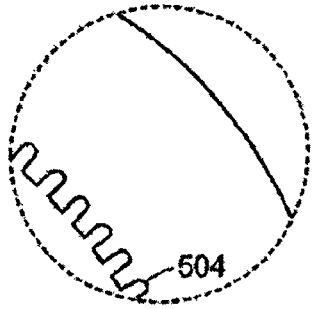

The extended heat transfer surfaces can be created by any of the methods known in the art. In accordance with a preferred embodiment of the invention, longitudinal grooves 504 are broached into the surface, as shown in detail in FIG. 5*a*. Alternatively, lateral grooves 508 may be machined in addition to the longitudinal grooves 504 thereby creating aligned pins 510 as shown in FIG. 5*b*. In accordance with yet another embodiment of the invention, grooves are cut at a helical angle to increase the heat exchange area.

In an alternative embodiment, the extended heat transfer surfaces on the gas interface 304 (as shown in FIG. 4*b*) of the cooler are formed from metal foam, expanded metal or other materials with high specific surface area. For example, a cylinder of metal foam may be soldered to the inside surface of the cooler 304. As discussed above, a cooler liner 126 (shown in FIG. 2) may be pressed in to form a gas barrier on the inner diameter of the metal foam. Other methods of forming and attaching heat transfer surfaces to the body of the cooler are described in co-pending U.S. patent application Ser. No. 09/884,436, filed Jun. 19, 2001, entitled Stirling Engine Thermal System Improvements, which is herein incorporated by reference.

All of the systems and methods described herein may be applied in other applications besides the Stirling or other pressurized close-cycle machines in terms of which the invention has been described. The described embodiments of the invention are intended to be merely exemplary and numerous variations and modifications will be apparent to those skilled in the art. All such variations and modifications are intended to be within the scope of the present invention as defined in the appended claims.

What is claimed is:

1. In a closed-cycle thermal engine, of the type contained within a pressure vessel and having a piston undergoing reciprocating linear motion within a cylinder and a working fluid heated by conduction through a heater head, the improvement comprising:

a heat exchanger for cooling the working fluid, the heat exchanger comprising a first material in thermally conductive contact with the working fluid, and a second and distinct material in thermal conductive contact with a coolant fluid; and a continuous section of coolant tubing providing for circulation of the coolant fluid to outside the pressure vessel, wherein a section of coolant tubing is contained within a cooler for directing a flow of working gas across the coolant tubing.

2. A closed-cycle thermal engine according to claim 1, wherein the heater head is directly coupled to the pressure vessel.

3. A closed-cycle thermal engine according to claim 1, wherein the heater head further includes a flange for transferring a mechanical load from the heater head to the pressure vessel.

4. A closed-cycle thermal engine, according to claim 1, wherein a section of the coolant tube is contained within the heat exchanger.

5. A closed-cycle thermal engine according to claim 1, wherein an outside diameter of a section of the coolant tube passes through the pressure vessel and is sealed to the pressure vessel.

6. A closed-cycle thermal engine according to claim 1, wherein a section of the coolant tube is disposed within a working volume of the heat exchanger.

7. A closed-cycle thermal engine according to claim 6, wherein the section of the coolant tube disposed within the working volume of the heat exchanger includes a plurality of extended heat transfer surfaces.

8. A closed-cycle thermal engine according to claim 6, further including at least one spacing element to direct a flow of the working gas to a specified proximity of the section of coolant tube in the working volume of the heat exchanger.

9. A closed-cycle thermal engine according to claim 6, wherein the heat exchanger further includes an annular heat sink surrounding the coolant tube wherein a flow of the working gas in the working volume of the heat exchanger is directed along at least one surface of the annular heat sink.

10. A closed-cycle thermal engine according to claim 1, wherein a section of the coolant tube is wrapped around an interior wall of the heat exchanger.

11. A closed-cycle thermal engine according to claim 1, wherein the pressure vessel contains a charge fluid, the pressurized closed-cycle engine further comprising a section of the coolant tube disposed within the pressure vessel in a manner adapted for cooling the charge fluid.

12. A closed-cycle thermal engine according to claim 11, further including a fan for circulating the charge fluid.

13. A method for transferring heat from a working fluid of a closed-cycle thermal engine, the closed-cycle thermal engine characterized by a pressure vessel including a crankcase volume filled with a charge gas, the method comprising:

a. transferring heat from the working fluid to a coolant that is separated from the working fluid at all points by at least two distinct solid materials; and b. circulating the coolant through a continuous section of coolant tubing to a region outside the pressure vessel, wherein a section of coolant tubing is contained within a cooler for directing a flow of working gas across the coolant tubing.

14. A method in accordance with claim 13, wherein the step of transferring heat from the working fluid to a coolant includes transferring heat within a cooler disposed within the crankcase volume.

15. A method in accordance with claim 13, further comprising:

transferring heat from the charge gas to the coolant.

16. A method in accordance with claim 13, wherein the two distinct solid materials include the coolant tubing and an overcast heat sink.

* * * * *